United States Patent [19]

Wittrock

[11] Patent Number: 4,823,390

[45] Date of Patent: Apr. 18, 1989

[54] FM STEREO GENERATOR

[75] Inventor: Glen R. Wittrock, Sioux Falls, S. Dak.

[73] Assignee: Sencore, Inc., Sious Falls, S. Dak.

[21] Appl. No.: 154,304

[22] Filed: Feb. 10, 1988

[51] Int. Cl.[4] ..... H04H 5/00

[52] U.S. Cl. ..... 381/4

[58] Field of Search ..... 381/2, 3, 4, 7, 14; 332/23 A

[56] References Cited

U.S. PATENT DOCUMENTS

| | | | |
|---|---|---|---|
| 4,112,259 | 9/1978 | Mendenhall | 381/7 |
| 4,194,161 | 3/1980 | Hershberger | 381/7 |
| 4,225,751 | 9/1980 | Hershberger | 332/23 A |
| 4,638,504 | 1/1987 | Salek | 332/23 A |
| 4,723,288 | 2/1988 | Borth et al. | 381/7 |

*Primary Examiner*—Forester W. Isen

*Attorney, Agent, or Firm*—Edmond T. Patnaude

[57] ABSTRACT

An FM stereo generator for use as a modulator or in a test instrument or the like to provide the conventional 19 KHz and 38 KHz signals. The phase of the generated 19 KHz pilot subcarrier signal is fixed relative to the 38 KHz carrier signal. The 38 KHz double sideband suppressed carrier signal is generated in a digital synthesis circuit to provide a stable 38 KHz carrier signal. The left and right stereophonic audio signals are applied to operational amplifiers to provide sum and difference audio components. The difference component is applied as an input to a double sideband suppressed carrier digital-to-analog converter which is responsive to the synthesis circuit to provide the 38 KHZ carrier signal. The 19 KHz pilot subcarrier signal is generated by a digital-to-analog converter that is clocked by a crystal timer which is common to both signals thereby to lock the phase of the pilot signal to the 38 KHz signal. The 19 KHz and 38 KHz signals are added without filtering which would otherwise adversely affect phasing precision. A master timing address chain is used to address memory sine tables stored in an EPROM. The 38 KHz circuit utilizes differentially cross-connected D/A converters each of which provide two-quadrant multiplication in response to a digital input word address derived from the EPROM. The combined outputs of the connected converters provide four-quadrant multiplication and carrier suppression. The EPROM includes sine wave tables for both the 19 KHz and the 38 KHz signals. An address counter, which is driven at the clock rate of the crystal timer, scans the data in the EPROM tables and applies the data as digital input words to the respective digital-to-analog converters.

13 Claims, 2 Drawing Sheets

FM STEREO GENERATOR

BACKGROUND OF THE INVENTION

This invention relates to an FM stereo generator for use as a modulator such as in a test instrument or the like. More particularly, the present invention relates to such a generator wherein the phase between the principal subcarriers is maintained relatively constant and wherein the relative amplitudes of the modulating signals are controlled.

In the United States, FM broadcasting is known and has been widely used. More recently, FM broadcasting has adopted stereophonic broadcasting where both left and right-hand signals are transmitted whereby the left and right-hand signals may be demodulated at the receivers to provide a stereophonic effect. The standards for such stereophonic broadcasting have been set and adopted by the government. Stereophonic FM broadcasting is basically a sum, L+R, and difference, L−R, method. The sum or L+R signal is transmitted on the main channel as normal audio modulation thereby providing an aurally-balanced program for the monophonic listener. The difference or L−R signal is transmitted as a suppressed carrier, amplitude modulated 38 KHz stereophonic subcarrier which frequency modulates the radiated carrier simultaneously with the main channel modulation. Because of the interweaving property of a difference or L−R stereophonic subcarrier signal and a sum or L+R audio signal, it is possible to fully modulate the FM transmitter with the main channel modulation and to insert the stereophonic subcarrier without having to reduce the modulation for either the sum or difference signal.

In accordance with present standards, a maximum modulation of 90 percent is allocated to both the sum and difference signals as applied to the propagated or radiated carrier. The remaining 10 percent of the maximum (100%) modulation allowable is allocated to a pilot subcarrier having a frequency one-half of the stereophonic subcarrier or 19 KHz. The 19 KHz pilot subcarrier frequency is required to be maintained within ±2 Hz and the limits of percent modulation of the radiated carrier allocated to the pilot subcarrier is 8 to 10 percent.

Current broadcasting standards also impose constraints on the phase relationship between the pilot subcarrier and the stereophonic subcarrier so that the left and right stereophonic channels are reproduced consistently and at the correct outputs. Further, when the radiated carrier is being deviated upwardly in frequency by the stereophonic subcarrier, a simultaneous positive slope of the pilot subcarrier modulation must also be maintained. The amplitude matching of the main and subchannel signals is required to be within ±3.5 percent of one another and the phase difference between the main and sub-channel signals is required to be within 3 degrees at all modulating frequencies between 50 Hz and 15 KHz. The required 75 millisecond preemphasis characteristic is applied to both the main and subchannel signals.

In the prior art, synthesizing circuits have been utilized to provide the main and subchannel signals for FM broadcasting. These include both direct and indirect synthesis configurations. In direct synthesis, a large number of separate oscillators are utilized and very sharp filters are further utilized to select the desired signals to add them for application to the FM broadcasting circuit. In the indirect method, the synthesis is provided utilizing phase-locked loops which have the disadvantage in that phase noise is undesirably generated.

These and other disadvantages are overcome by the present invention wherein an FM stereo generator is provided wherein the required phase and amplitude control characteristics are provided to meet government standards without the attendant disadvantages of the prior art.

SUMMARY OF THE INVENTION

Briefly, an FM stereo generator is provided which generates both the pilot and stereophonic subcarrier signals. Means are provided for applying left and right stereophonic audio signals to the generator. Means are receptive of the audio signals for providing sum and difference components of the audio signals. A source of clock pulses cooperates with a digital synthesis circuit which is responsive to the clock pulses and the difference components for providing a modulated double-sideband suppressed carrier signal. A digital-to-analog converter is coupled to the circuit and is responsive to the clock pulses for providing a pilot subcarrier signal whose phase is commonly derived with the phase of the double sideband suppressed carrier signal. Means are provided for adding the pilot and suppressed carrier signals and applying the added signals to an output of the generator.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
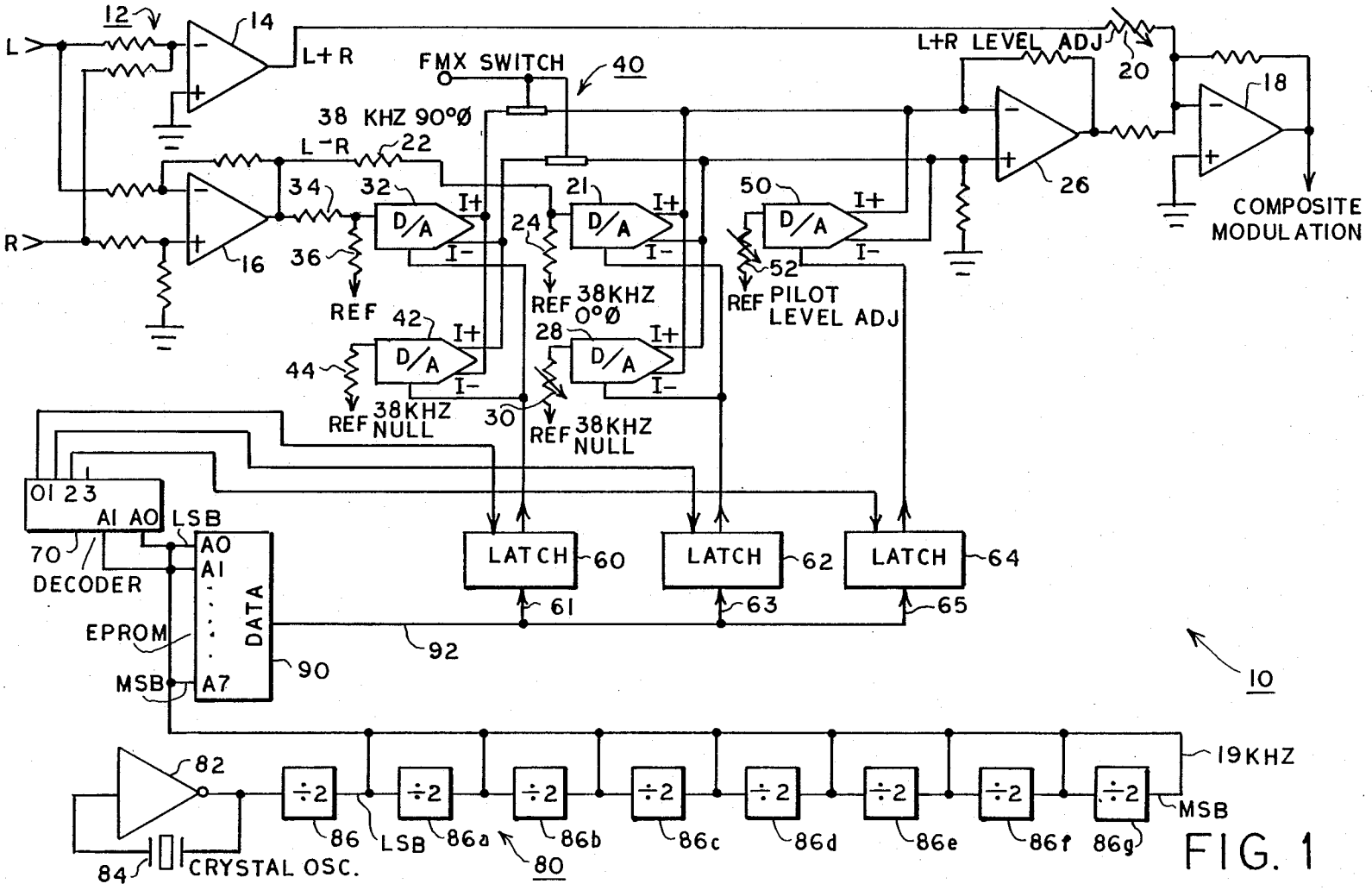
FIG. 1 is a combined block and schematic diagram illustrating the FM stereo generator in accordance with the principles of the present invention.

Referring now to FIG. 1, there is shown generally at 10 a combined block and schematic diagram of the FM stereo generator in accordance with the teachings of the present invention. Generator 10 includes a circuit shown generally at 12 for receiving the stereophonic audio input signals L and R. The left audio signal L is provided as a first, inverting, input to operational amplifiers 14 and 16. The right audio signal R is applied to the first normal input of amplifier 16 and to the inverted input of amplifier 14. Accordingly, the output of amplifier 14 provides the sum or L+R signal which is coupled as an inverted input to output amplifier 18 by way of a level adjusting potentiometer 20. The output of amplifier 16 provides the difference audio or L−R signal which is applied as an input to digital-to-analog (D/A) converter 21 by way of a resistor 22. The input of D/A converter 21 is also coupled to a point of reference potential by way of a second resistor 24. The output of D/A converter 21 includes a true or normal I+ and a complimentary or inverted output I− which are respectively coupled as inputs to an operational amplifier 26. D/A converter 28 forms part of the 38 KHz-0°$\phi$ generator in conjunction with a second D/A converter 28. D/A converter 20 has an input coupled to a point of reference potential by way of a potentiometer 30. The outputs of D/A converter 28 are cross coupled with the outputs of D/A converter 21.

The output of amplifier 16 is also coupled as a first input to the D/A converter 32 by way of a resistor 34. The input of D/A converter 32 is also coupled to a point of reference potential by way of a resistor 36. The normal and inverted outputs of D/A converter 32 are coupled to amplifier 26 by way of an FMX switch shown generally at 40 and which may take the form of a relay or any other suitable switching device. The FMX switch is utilized to provide a 38 KHz-90°$\phi$ output signal for use in FMX systems which are presently under development. D/A converter 32 forms a 38 KHz-90° signal generator in conjunction with a second D/A converter 42 whose normal and inverted inputs are cross coupled with the outputs of D/A converter 32. The input of D/A converter 42 is coupled to a point of reference potential by way of a potentiometer 44 and the outputs of D/A converter 42 are cross coupled in a manner similar to D/A converter 28 of the 38 KHz-0° signal generator circuit.

The 19 KHz pilot subcarrier circuit includes an additional D/A converter 50 whose normal and inverted outputs are also respectively connected to the inputs of amplifier 26. The input of D/A converter 50 is coupled to an adjustable point of reference potential by way of a potentiometer 52. Potentiometer 52 provides a pilot signal level adjustment so that the 38 KHz and 19 KHz output signal levels can be matched and controlled to provide precise control of their relative amplitudes in accordance with the present invention. The inputs to the described D/A converters include digital word inputs which are respectively coupled to and stored as output signals in latch circuits 60, 62 and 64. The digital word inputs to D/A converters 32 and 42 are parallel connected as one word, as are the digital word inputs to D/A converters 21 and 28. Latch circuits 60, 62 and 64 include control inputs which are coupled to a decoder 70. In currently preferred practice, each latch circuit comprises a 74LS377 integrated circuit latch device.

FM stereo decoder 10 further includes a timing chain shown generally at 80 which includes an inverting amplifier 82 and a parallel resonant crystal 84 which together form a crystal oscillator. The output of amplifier 82 is coupled to a first divide-by-two circuit 86 which in turn has an output which is successively coupled through divide-by-two circuits **86*a*, 86*b*, 86*c*, 86*d*, 86*e*, 86*f*, and 86*g*. In currently preferred practice, each divide-by-two circuit comprises a 74HC191 integrated circuit synchronous counter; and crystal 84 has an operating frequency of 4.864 MHz such that the output of the last divide-by-two circuit 86*g* is 19 KHz. The output of circuit 86*g* represents the most significant bit MSB. The output of circuit 86** represents the least significant bit LSB.

The eight outputs of circuits 86 and **86*a*–86*g* are respectively coupled as eight inputs A0–A7 to an EPROM 90 and as two inputs A0 and A1 to decoder 70. Timing chain 80 is used to address the memory sine tables stored in EPROM 90. These tables when sequentially clocked into the respective A/D converters produce the 38 KHz and 19 KHz subcarrier signals. EPROM 90 is an electrically programmed ROM which is programmed to provide a repeating sequence of three digital words at its output 92 in response to the clock pulses provided by timing chain 80. Each digital word represents a point along the full cycle of its respective sine wave signal. The respective D/A converters convert the respective strings of digital words into the resulting sine wave. The sequentially repeating digital words provided at the output 92 of EPROM 90 are respectively provided as inputs 61, 63 and 65 to latch circuits 60, 62, and 64. Each LSB at A0 is a latch pulse which sequentially steps decoder 70 and thereby respectively transfers data from EPROM 90 to the outputs of latch circuits 60, 62 and 64** and therefore to the respectively connected D/A converters.

Figure 2:
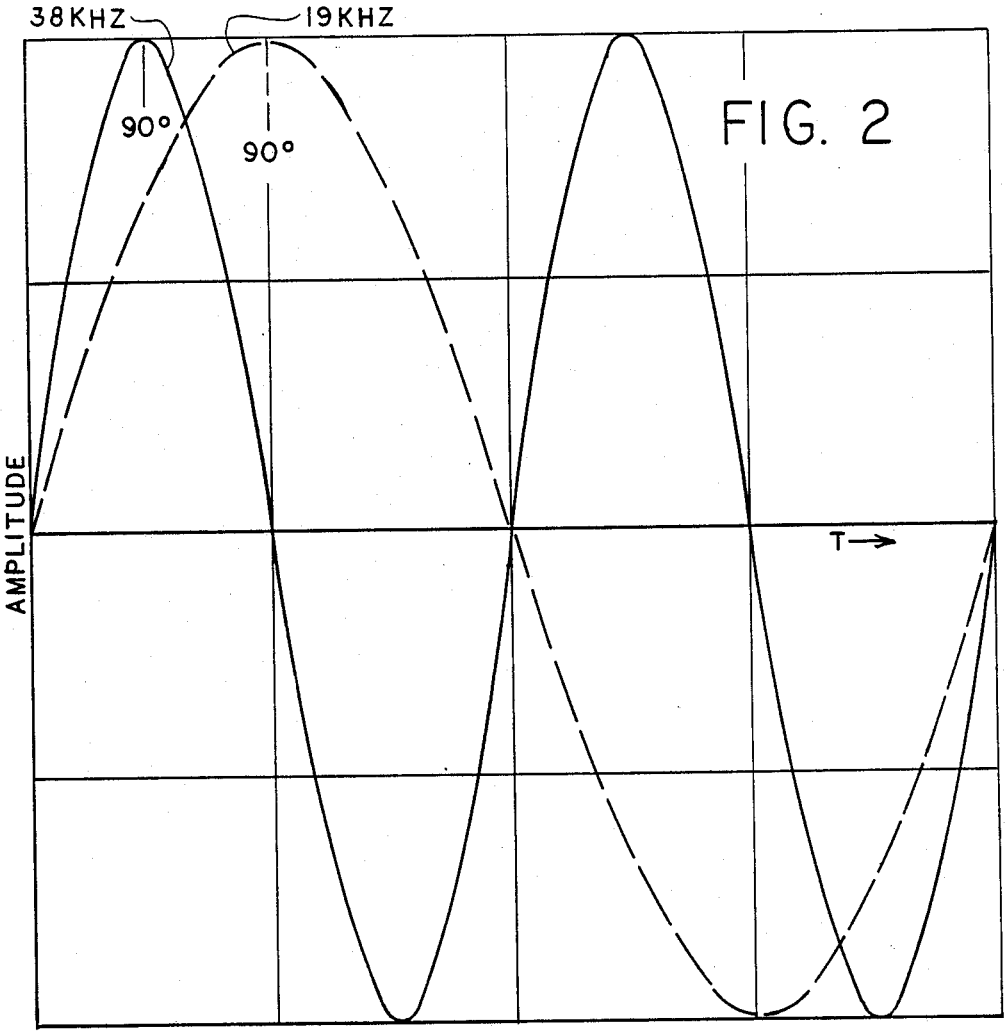
FIG. 2 is a graph illustrating the relationship between the pilot and stereophonic subcarrier signals as generated within the digital synthesizing circuit in accordance with the present invention.

Referring now to FIG. 2 there is shown a graphical illustration of the sine wave output signals provided by D/A converters 21 and 50 in response to the digital words stored in latch circuits 62, 64, which digital word outputs are provided by EPROM 90. The two sine waves signals depicted in FIG. 2 correspond to the 38 KHz and 19 KHz output signals which correspond to two tables in the EPROM. Since latch circuits 62 and 64, as well as EPROM 90, are simultaneously clocked by timing chain 80, it can be seen that the output signals are in phase with one another. That is, the data outputs representing the programmed sine wave tables of EPROM 90 result in sine waves which start in phase at t=0 along the abscissa of the graph of FIG. 2. It can be seen that after one cycle of the 38 KHz-0°$\phi$ signal the sine wave 19 KHz output goes through 180° or one-half of its cycle and is in phase with the cycle of the 38 KHz signal.

Figure 3:
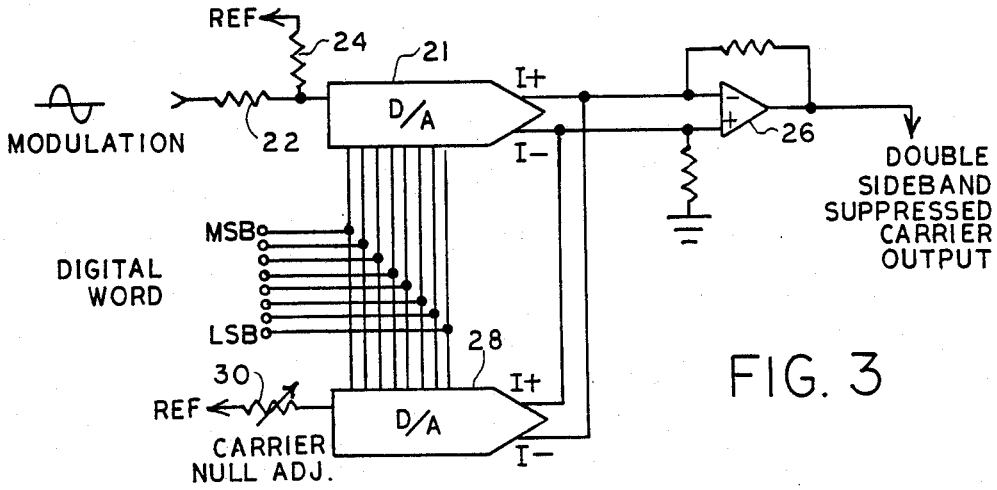
FIG. 3 is a combined block and schematic diagram of a pair of cross-coupled digital-to-analog converters for use in the generator system illustrated in FIG. 1.

Referring now to FIG. 3 there is shown a more detailed diagram of the D/A converters 21 and 28 of FM stereo generator 10 of FIG. 1. It can be seen that the eight outputs of the digital word stored in latch circuit 62 are provided as parallel inputs to D/A converters 21 and 28. The eight outputs of the digital word latch circuit 62 are represented between MSB and LSB.

The operation of FM stereo generator 10 is described as follows: The timing address chain 80 is used to address the memory sine tables in EPROM 90. These tables, when clocked into the respective D/A converters produce the 38 KHz and 19 KHz signals. Only the data stored or held in latch circuits 60, 62 and 64 determined D/A converter outputs. In three clock cycles, address decorder 70 controls the output data from EPROM 90. Three successive D/A numbers are loaded from EPROM 90 into latch circuits 60, 62 and 64. Since these signals are derived from a common source, this ensures a constant phase and frequency relationship between the signals. Generator 10 utilizes the look-tables of EPROM 90 and the timing address chain 80 which is driven at the given clock rate. The timing chain scans the data in the look-tables of EPROM 90 and couples this data to the respective D/A converters. The EPROM look-up tables store sine wave values that are predetermined and computed for the amplitude number at the time at which the address is clocked. This data is then latched into the respective latch circuits and the D/A converters use this data which contains the desired sine wave amplitude and phase-angle information. The respective D/A converters then generate the generator output waveforms. Since the output signals are digitally generated, the phase of the double sideband 38 KHz generator is locked to the 19 KHz pilot signal sine wave.

The double sideband suppressed carrier signal provided by cross-connected D/A converters 21 and 28 results from four-quadrant multiplication wherein each D/A converter provides two-quadrant multiplication. Each two-quadrant multiplication is bipolar analog wherein the analog reference input controls the output polarity. The bi-polar reference voltage provides a reference current which determines the full scale current output of the D/A converter to the subsequent operational amplifier. The bi-polar reference is connected to D/A converter 21 and modulates the reference current around a quiescent value. The percent modulation is a percentage expressed by the ratio of the modulating current divided by the reference current. D/A converter 28 utilizes the same reference current which is adjusted by the carrier null adjustment 30. Since D/A converters 21 and 28 have parallel digital word inputs, D/A converter 28 effectively subtracts the quiescent reference current of D/A converter 21 at all digital input word codes. Since the input resistors of both devices are equal, the output modulation of cross-connected D/A converters 21 and 28 is a product of a digital input word and the applied bipolar analog modulation. Carrier suppression or subtraction to provide the double sideband suppressed carrier signal is provided by cross-connecting the D/A converters. With this configuration, the "carrier", which is represented as a series of numbers to each D/A converts, is cancelled. Further, the carrier sine function at the input is an offset-binary-coded word which is symmetrical. This symmetrically offset binary function makes the output center about ground potential. The result of combining the two forms of two-quadrant multiplication of D/A converters 21 and 28 is four-quadrant multiplication. The output analog polarity is controlled by the analog input and the offset binary digital input word. Finally, since the digitally generated sine waves are generated from a common clock source, the phase of the 38 KHz double sideband generator signal is locked to the 19 KHz pilot carrier sine wave. This then provides stable stereo operation.

What has been taught, then, is an FM stereo generator which provides precise phase and amplitude control between the subcarrier signals and which overcomes the disadvantages of the prior art. The form of the invention illustrated and described herein is but a preferred embodiment of these teachings. It is shown as an illustration of the inventive concepts, however, rather than by way of limitation, and it is pointed out that various modifications and alterations may be indulged in within the scope of the appended claims.

What is claimed is:

1. An FM stereo generator for providing 19 KHz and 38 KHz signals, said circuit comprising in combination:

means for applying left and right stereophonic audio signals to said generator;

means receptive of said audio signals for providing sum and difference components of said audio signals;

a source of clock pulses;

a digital synthesis circuit responsive to said clock pulses and said difference components for providing a modulated double sideband suppressed carrier signal;

a digital-to-analog converter coupled to said circuit and being responsive to said clock pulses for providing a pilot subcarrier signal whose phase is commonly derived with the phase of said double sideband suppressed carrier signal; and, means for adding said pilot and suppressed carrier signals and combining the added signals with said sum component.

2. The generator according to claim 1, wherein said digital synthesis circuit includes a pair of cross-connected digital-to-analog converters wherein each converter of said pair includes a normal output and an inverted output with each normal output being connected to the inverted output of the other converter of said pair and wherein a first one of said pair of converters includes an input for receiving said difference components and the other converter of said pair includes an input for receiving an adjustable reference potential, and wherein each converter of said pair includes a control input for receiving a common digital word input signal.

3. The generator according to claim 2, wherein said generator includes an EPROM device connected between said source and said pair of converters for providing said digital word input signal in response to said clock pulses.

4. The generator according to claim 3, wherein the outputs of said pair of converters are respectively coupled as inputs to the normal and inverted inputs of an amplifier and wherein the output of said amplifier is a product of said digital input signal and said difference components.

5. The generator according to claim 3, wherein said EPROM provides a first digital word input to said pair of converters and a second digital word input to the converter which provides said pilot signal.

6. The generator according to claim 5 including first and second latch circuits respectively coupled between said EPROM and said converters.

7. The generator according to claim 6, including a decoder having an input coupled to said source of clock pulses and having first and second outputs respectively coupled to said first and second latch circuits, said decoder being responsive to said clock pulses for sequentially respectively applying said first and second digital words to their respective converters via said latches.

8. The generator according to claim 7 wherein said first digital word corresponds to a 38 KHz sine wave signal and wherein said second digital word corresponds to a 19 KHz signal.

9. The generator according to claim 2, wherein said generator includes means for providing a first digital word input to said pair of converters and a second digital word input to a digital word input of the converter which provides said pilot signal.

10. The generator according to claim 9 including first and second latch circuits respectively coupled between said means for providing said digital words and said converters.

11. The generator according to claim 10, including a decoder having an input coupled to said source of clock pulses and having first and second outputs respectively coupled to said first and second latch circuits, said decoder being responsive to said clock pulses for sequentially respectively applying said first and second digital words to their respective converters.

12. The generator according to claim 11, wherein said first digital word corresponds to a 38 KHz sine wave signal and wherein said second digital word corresponds to a 19 KHz signal.

13. A method for providing FM stereo 19 KHz and 38 KHz signals, said method comprising the steps of:

applying left and right stereophonic audio signals to a signal generator;

providing sum and difference components of said audio signal;

providing a source of clock pulses;

providing a modulated double sideband suppressed carrier signal in a digital synthesis circuit responsive to said clock pulses and said difference components;

providing a pilot subcarrier signal from a digital-to-analog converter which is coupled to said circuit and which is responsive to said clock pulses wherein the phase of said pilot signal is commonly derived with the phase of said double sideband suppressed carrier signal; and, adding said pilot and suppressed carrier signals and combining the added signals with said sum component.

* * * * *